US012398450B2

(12) United States Patent
Hu et al.

(10) Patent No.: US 12,398,450 B2
(45) Date of Patent: Aug. 26, 2025

(54) ULTRA-THIN ULTRA-HIGH STRENGTH STEEL WIRE, WIRE ROD AND METHOD OF PRODUCING WIRE ROD

(71) Applicants: INSTITUTE OF RESEARCH OF IRON AND STEEL, JIANGSU PROVINCE/SHA-STEEL, CO., LTD., Suzhou (CN); JIANGSU SHAGANG GROUP CO., LTD., Suzhou (CN)

(72) Inventors: Xianjun Hu, Suzhou (CN); Jinxi Fan, Suzhou (CN); Han Ma, Suzhou (CN); Feng Fang, Suzhou (CN); Long Cheng, Suzhou (CN)

(73) Assignees: INSTITUTE OF RESEARCH OF IRON AND STEEL, JIANGSU PROVINCE/SHA-STEEL, CO., LTD., Suzhou (CN); JIANGSU SHAGANG GROUP CO., LTD., Suzhou (CN)

( * ) Notice: Subject to any disclaimer, the term of this patent is extended or adjusted under 35 U.S.C. 154(b) by 697 days.

(21) Appl. No.: 17/619,231

(22) PCT Filed: Aug. 19, 2019

(86) PCT No.: PCT/CN2019/101310
§ 371 (c)(1),
(2) Date: Dec. 14, 2021

(87) PCT Pub. No.: WO2021/007915
PCT Pub. Date: Jan. 21, 2021

(65) Prior Publication Data

US 2022/0243310 A1 Aug. 4, 2022

(30) Foreign Application Priority Data

Jul. 16, 2019 (CN) ..... 201910638740.0

(51) Int. Cl.
*C22C 38/50* (2006.01)
*B21B 1/16* (2006.01)
(Continued)

(52) U.S. Cl.
CPC ..... *C22C 38/50* (2013.01); *B21B 1/16* (2013.01); *C21D 9/52* (2013.01); *C22B 9/18* (2013.01);
(Continued)

(58) Field of Classification Search
CPC .. B21B 1/16; C21C 7/076; C21C 7/10; C21D 11/005; C21D 6/00; C21D 6/004;
(Continued)

(56) References Cited

U.S. PATENT DOCUMENTS 6,596,098 B1 * 7/2003 Nishida ..... C22C 38/04 148/333

FOREIGN PATENT DOCUMENTS

CN 1772939 A 5/2006
CN 101899622 A * 12/2010
(Continued)

OTHER PUBLICATIONS

NPL: on-line translation of CN-110088318-A,, Aug. 2019 (Year: 2019).*
(Continued)

*Primary Examiner* — Jie Yang
(74) *Attorney, Agent, or Firm* — Muncy, Geissler, Olds & Lowe, P.C.

(57) ABSTRACT

The present invention reveals an ultra-thin ultra-high strength steel wire, a wire rod for an ultra-thin ultra-high strength steel wire and its producing method. The chemical components of the wire rod comprise in percentage by mass: C 0.90~0.96%, Si 0.12~0.30%, Mn 0.30~0.65%, Cr 0.10~0.30%, Al≤0.004%, Ti≤0.001%, Cu≤0.01%,
(Continued)

Ni≤0.01%, S≤0.01%, P≤0.01%, O≤0.0006%, N≤0.0006%, and the balance is Fe and unavoidable impurity elements. The wire rod for the ultra-thin ultra-high strength steel wire may be used as a base material for producing the ultra-thin ultra-high strength steel wire having a diameter in a range of 50~60 μm and a tensile strength larger than or equal to 4500 MPa.

7 Claims, 1 Drawing Sheet

(51) Int. Cl.

| | |
|---|---|
| ***C21D 9/52*** | (2006.01) |
| ***C22B 9/18*** | (2006.01) |
| ***C22C 33/04*** | (2006.01) |
| ***C22C 38/00*** | (2006.01) |
| ***C22C 38/04*** | (2006.01) |
| ***C22C 38/06*** | (2006.01) |
| ***C22C 38/18*** | (2006.01) |
| ***C22C 38/42*** | (2006.01) |

(52) U.S. Cl.
CPC ..... *C22C 33/04* (2013.01); *C22C 38/001* (2013.01); *C22C 38/002* (2013.01); *C22C 38/04* (2013.01); *C22C 38/06* (2013.01); *C22C 38/18* (2013.01); *C22C 38/42* (2013.01)

(58) Field of Classification Search
CPC ..... C21D 6/008; C21D 8/065; C21D 9/52; C22B 9/18; C22C 1/02; C22C 33/04
See application file for complete search history.

(56) References Cited

FOREIGN PATENT DOCUMENTS

| | | | | | |
|---|---|---|---|---|---|
| CN | 103882313 | A | | 6/2014 | |
| CN | 106475432 | A | | 3/2017 | |
| CN | 106661694 | A | | 5/2017 | |
| CN | 108239735 | A | | 7/2018 | |
| CN | 108866433 | A | | 11/2018 | |
| CN | 109439961 | A | | 3/2019 | |
| CN | 109762999 | A | * | 5/2019 | |
| CN | 110088318 | A | * | 8/2019 | ..... C21D 6/002 |
| JP | 860-215738 | A | | 10/1985 | |
| JP | H4-311523 | A | | 11/1992 | |
| JP | 2575544 | B2 | | 1/1997 | |

OTHER PUBLICATIONS

NPL: on-line translation of CN-109762999-A, May 2019 (Year: 2019).*

NPL: on-line translation of CN 101899622 A, Dec. 2010 (Year: 2010).*

Qun Li, Wei Fang, Xiaojun Hu, "Investigation on the Cold-drawing Process of SUS304 Austenitic Stainless Steel Wire for Cutting with Super-Tensile Strength", Steel Wire Products, Jun. 1999, pp. 20-22, vol. 25, Issue No. 3, China Academic Journal Electronic Publishing House.

* cited by examiner

ULTRA-THIN ULTRA-HIGH STRENGTH STEEL WIRE, WIRE ROD AND METHOD OF PRODUCING WIRE ROD

This application is a 35 U.S.C. § 371 National Phase conversion of International (PCT) Patent Application No. PCT/CN2019/101310, filed on Aug. 19, 2019, which claims the priority of Chinese patent application, the filing date of which is Jul. 16, 2019, the application number is 201910638740.0, and the title of invention is "ultra-thin ultra-high strength steel wire, wire rod and method of producing wire rod", the entire contents of which are incorporated herein by reference in its entirety. The PCT International Patent Application was filed and published in Chinese.

TECHNICAL FIELD

The present invention belongs to the technical field of steel and iron smelting, relates to a wire rod for an ultra-thin ultra-high strength steel wire, further to an ultra-thin ultra-high strength steel wire obtained by processing using the wire rod for the ultra-thin ultra-high strength steel wire, and to a method of producing the wire rod for the ultra-thin ultra-high strength steel wire.

BACKGROUND

The ultra-thin ultra-high strength steel wire is a high-strength steel wire applied to the industry and often used as a cutting steel wire for cutting materials such as solar wafers, quartz materials and monocrystalline silicon. The cutting steel wire, also referred to as a cutting wire, a cutting steel line or a cutting line, is a specially-produced wire material for cutting, is also a special steel wire which has a diameter smaller than 0.20 mm and whose surface is plated with zinc copper, and is widely applied as a consumable material to fields such as energy, aviation, equipment and public utilities. Even minute diamond particles may be inlaid on the cutting steel wire to produce a diamond cutting line, which is also referred to as a diamond line, a diamond cutting line, or a diamond line.

To reduce the loss of the cut material such as the silicon material, the performance of the cutting steel wire develops in a tendency towards a smaller diameter, a longer mileage of the continuous wire without break and a higher strength. These performances are affected by the inclusions and the tensile strength of the wire rod for the cutting steel wire. At present, since the wire rod for the cutting steel wire fabricated by a production process in the technical field has problems such as a large size of the inclusion, a large amount and density of the inclusion and a low tensile strength, the performances of the conventional cutting steel wire cannot meet the market needs.

SUMMARY

To solve at least one of the above technical problems, an object of the present invention is to provide a wire rod for an ultra-thin ultra-high strength steel wire, to an ultra-thin ultra-high strength steel wire obtained by processing using the wire rod for the ultra-thin ultra-high strength steel wire, and to a method of producing the wire rod for the ultra-thin ultra-high strength steel wire.

To achieve one of the above objects, an embodiment of the present invention provides a wire rod for an ultra-thin ultra-high strength steel wire. The chemical components of the wire rod comprise in percentage by mass: C 0.90~0.96%, Si 0.12~0.30%, Mn 0.30~0.65%, Cr 0.10~0.30%, Al≤0.004%, Ti≤0.001%, Cu≤0.01%, Ni≤0.01%, S≤0.01%, P≤0.01%, O≤0.0006%, N≤0.0006%, and the balance is Fe and unavoidable impurity elements. The wire rod for the ultra-thin ultra-high strength steel wire may be used as a base material for producing the ultra-thin ultra-high strength steel wire having a diameter in a range of 50~60 μm, a tensile strength larger than or equal to 4500 MPa, and a mileage of the resultant continuous wire without break larger than or equal to 300 km achieved during a process of further drawing the wire rod into the ultra-thin ultra-high strength steel wire.

The size, strength and purity of the wire rod for the ultra-thin ultra-high strength steel wire are controlled by controlling the chemical components and mass percentages, wherein the structure and strength of the wire rod for the ultra-thin ultra-high strength steel wire are controlled by controlling content of elements such as C, Si, Mn and Cr and carbon-free segregation in the wire rod; the amount of inclusions is controlled by controlling the content of elements such as Al, Ti, O and N that generate brittle inclusions.

C is a major element of steel and decides a metallographic structure and performance of solidified molten liquid, a too low content of C does not facilitate the drawing strength of the steel wire, and a too high content of C causes the wire rod to harden too fast during drawing and increases the break rate of the wire drawn from the wire rod. Controlling the C content in the wire rod in a range of 0.90~0.96% may not only ensure the strength of the wire rod and the steel wire, but also reduce the break rate when the wire rod and steel wire are drawn, to fabricate the wire rod for the ultra-thin ultra-high strength steel wire.

Si is a major deoxidizing element. A too low content of Si causes insufficient deoxidization of the molten steel. A too high content of Si causes reduction of the plasticity and ductility of the steel material. Particularly when Si occurs in the steel material in the form of a silicate inclusion, the drawn wire is prone to break. The control of the content of Si in the wire rod may ensure sufficient deoxidization of the molten steel on the one hand, and on the other hand, improve the ductility of the wire rod and steel wire and reduce the break rate when the wire rod and steel wire are drawn.

Mn, as a deoxidizer and a desulfurizing agent, has a larger affinity with O and S than Fe. When the content of Mn is too high, the hardenability increases, the steel structure after the hot rolling is apt to transform into a bainite and a martensite so that the toughness of the steel material decreases and a yield rate is low. Controlling the content of Mn in the wire rod in a range of 0.30~0.65% may, on the one hand, ensure the deoxidizing and desulfurizing effect, and on the other hand, ensure the toughness and stability of the wire road and steel wire and reduce the break rate of the wire upon drawing.

Cr may improve the strength and hardenability of the wire rod, refine the structure of the wire rod made of high carbon steel, reduce the inter-layer distance of the martensite, and improve the drawing performance of the wire rod. However, a too high content of Cr will make the strength and hardness of the wire rod too large so that the wire rod hardens seriously during the drawing process and the drawing performance is poor. Controlling the content of Cr in the wire rod in a range of 0.10~0.30% makes the wire rod have a high strength and an excellent drawing performance.

Al, as a deoxidizing agent in the steel, reduces the content of full oxygen in the molten steel. However, Al is apt to form $Al_2O_3$. $Al_2O_3$ has a very poor deformability and is an inclusion that is avoided in the steel wire rod and steel wire as much as possible. The lower the content of Al is, the better the performance is. The content of Al in the wire rod is controlled less than or equal to 0.004% to reduce the content of the inclusion and improve the purity of the wire rod.

Ti is a harmful residual element and very prone to form, with interstitial atoms such as C and N, a cubic or parallelepiped Ti (C, N) having edges, and affects the drawing performance and anti-fatigue performance of the steel material. The lower the content of Ti is, the better the performance is. The content of Ti in the wire rod is controlled less than or equal to 0.001% to avoid impact on the drawing performance and the anti-fatigue performance of the wire rod.

Cu, Ni, S and P are harmful impurity elements. The lower the content thereof is, the better the performance is. The content of the elements in the wire rod is controlled as Cu≤0.01%, Ni≤0.01%, S≤0.01%, and P≤0.01% to avoid their adverse impacts on respective performances of the wire rod.

The non-metallic inclusions in the steel material are mainly oxides. O in the steel material at the room temperature almost all exists in form of oxides. A higher content of full oxygen indicates a larger content of the oxide inclusions, and causes an adverse impact on the purity and size of finished products of the drawn steel wire. Therefore, controlling the content of full oxygen less than or equal to 0.0006% may substantially reduce the amount of the inclusions in the wire rod, improve the purity of the wire rod and steel wire, and fabricate the drawn steel wires having a smaller diameter and a longer mileage of continuous wire without break.

The element N causes the hardening and increase of the wire breaking rate during the processing of the wire rod. Controlling the content of N less than or equal to 0.0006% may increase the mileage of the continuous wire while the steel wire is fabricated by drawing.

Preferably, the chemical components of the wire rod comprise in percentage by mass: C 0.90~0.94%, Si 0.12~0.30%, Mn 0.30~0.65%, Cr 0.10~0.30%, Al≤0.004%, Ti≤0.001%, Cu≤0.01%, Ni≤0.01%, S≤0.01%, P≤0.01%, O≤0.0006%, N≤0.0006%, and the balance is Fe and unavoidable impurity elements.

Preferably, a size of the inclusion in the wire rod for the ultra-thin ultra-high strength steel wire is less than or equal to 4 μm, and an average density of a brittle inclusion is less than or equal to 2/mm$^2$. An ultra-thin ultra-high strength steel wire which is thinner and has a longer mileage of continuous wire without break and a super-high purity may be fabricated by drawing further.

Preferably, a diameter of the wire rod for the ultra-thin ultra-high strength steel wire is 5.5 mm. An ultra-thin steel wire having a diameter in a range of 50~60 μm may be fabricated by drawing further.

Preferably, the wire rod for the ultra-thin ultra-high strength steel wire has a sorbite rate larger than or equal to 95%, an area reduction rate larger than or equal to 40%, and a tensile strength larger than or equal to 1300 MPa. An ultra-thin ultra-high strength steel wire which is thinner and has a higher tensile strength and a longer mileage of continuous wire without break may be fabricated by drawing further.

Correspondingly, to achieve one of the above objects, an embodiment of the present invention further provides an ultra-thin ultra-high strength steel wire which is fabricated from the wire rod for the ultra-thin ultra-high strength steel wire as a base material.

Preferably, the ultra-thin ultra-high strength steel wire has a diameter in a range of 50~60 μm, a tensile strength larger than or equal to 4500 MPa, and a mileage without break during the drawing longer than or equal to 300 km. The ultra-thin ultra-high strength steel wire can not only meet requirements for the diameter of the cut wire, the mileage of the continuous wire without break and strength of the wire in the current industry, but also put into production in a scale.

To achieve one of the above objects, an embodiment of the present invention further provides a method of producing a wire rod for an ultra-thin ultra-high strength steel wire, and the method comprises the following steps:

Smelting: melting a charge into molten steel in a vacuum induction smelting furnace, refining the molten steel and regulating chemical components and inclusions in molten steel, and pouring the molten steel and casting to obtain a steel ingot;

Remelting: crystallizing and remelting the steel ingot to obtain a remelted ingot;

Forging: performing a homogenization thermal process for the remelted ingot, and then performing forging to obtain a billet;

Steel rolling: rolling the billet at a temperature in a range of 900~1100° C. to fabricate the wire rod for the ultra-thin ultra-high strength steel wire, where the chemical components of the wire rod for the ultra-thin ultra-high strength steel wire comprises in percentage by mass: C 0.90~0.96%, Si 0.12~0.30%, Mn 0.30~0.65%, Cr 0.10~0.30%, Al≤0.004%, Ti≤0.001%, Cu≤0.01%, Ni≤0.01%, S≤0.01%, P≤0.01%, O≤0.0006%, N≤0.0006%, and the balance is Fe and unavoidable impurity elements.

According to a production method in an embodiment of the present invention, on one hand, through steps such as the smelting and remelting, precise control of chemical components of the wire rod for the ultra-thin ultra-high strength steel wire is achieved, and the strength and the drawing performance thereof are improved; on the other hand, it is possible to, by remelting, control the components and crystallization directions of the inclusions, remove the inclusions to a larger degree, reduce the sizes of the inclusions, improve the purity of the wire rod, and further control the wire rod free from central segregation. As a result, the chemical components and inclusions of the finally-fabricated wire rod for the ultra-thin ultra-high strength steel wire are effectively and precisely controlled, and the wire rod is ensured to have a high strength, an excellent drawing performance and a high purity, and it is further ensured that the ultra-thin ultra-high strength steel wire fabricated by drawing from the wire rod has an ultra-small diameter, an ultra-high tensile strength, a super-long mileage of continuous wire without break and an ultra-high purity.

As a further improvement of an embodiment of the present invention, the remelting step comprises electroslag remelting, or/and vacuum consumable remelting.

The electroslag remelting involves using the resistance heat generated by an electrical current flowing through the electroslag to heat, purifying the steel ingot through a molten steel-slag reaction and high-temperature vaporization to remove non-metallic inclusions to make the surface of the steel ingot clean and smooth. Meanwhile, due to the directionality of the heat conduction, the crystallization direction may be controlled, and segregation may be reduced effectively. Therefore, the structure of the steel ingots is more uniform and compact, and the plasticity and toughness of the steel ingots at a low temperature, a room temperature and a high temperature are enhanced, so that it can be ensured that the finally-fabricated wire rod for the ultra-thin ultra-high strength steel wire has a higher strength, a higher purity and excellent roughness and drawing performance. The vacuum consumable remelting is performed by heating through electric arc, may avoid contact between the molten steel and atmosphere upon remelting under a vacuum and high-temperature condition, and partial non-metallic inclusions may be dissociated or reduced via carbon to be removed. Meanwhile, the vacuum consumable remelting may further remove gases and some harmful impurities with a low melting point, so that the cold and heat processing performance, plasticity and mechanical properties and physical performance of the resultant steel ingot can be substantially improved, particularly, improve the difference between the longitudinal and transverse performances, improve its stability, homogeneity and reliability, further ensure that the finally-fabricated wire rod for the ultra-thin ultra-high strength steel wire has a higher strength, a higher purity and excellent roughness and drawing performance.

As a further improvement of an embodiment of the present invention, in the electroslag remelting step, the chemical components of the slag comprise in percentage by mass: CaO 6~14%, $Al_2O_3$ 8~15%, $SiO_2$ 20~28%, MgO<5%, and the balance is $CaF_2$. It is possible to, by optimizing the proportion of the slag, ensure the slag-forming effect in the electroslag remelting step, and further ensure the components, sizes, amount and density of inclusions in the finally-fabricated wire rod for the ultra-thin ultra-high strength steel wire are optimized.

As a further improvement of an embodiment of the present invention, in the electroslag remelting step, the chemical components of the slag comprise in percentage by mass: CaO 10%, $Al_2O_3$10%, $SiO_2$ 25%, and the balance is $CaF_2$. It is possible to, by further optimizing the proportion of the slag, ensure that the slag-forming effect in the electroslag remelting step is optimized, and further ensure the components, sizes, amount and density of inclusions in the finally-fabricated wire rod for the ultra-thin ultra-high strength steel wire are optimized.

As a further improvement of an embodiment of the present invention, in the electroslag remelting step, the melting speed is in a range of 6.5~7.5 kg/min. The melting speed in this range can not only ensure that the steel ingot has an excellent crystallization quality and surface quality, the steel ingot does not have solidification drawbacks such as shrinkage cavity, porosity and segregation, and the surface of the steel ingot is smooth, but also minimize electricity consumption, save energy, and thereby ensure finally-fabricated wire rod for the ultra-thin ultra-high strength steel wire has a high strength, and excellent roughness and drawing performance.

As a further improvement of an embodiment of the present invention, the electroslag remelting step comprises the following in order:

A slag-forming stage;

A pressure-controlling stage: controlling the pressure of the smelting furnace to a range of 2~5 MPa, and making the pressure of cooling water in a crystallizer in a range of 2~5 MPa;

An electroslag smelting stage: the voltage is in a range of 35~38V, the electrical current is in a range of 8500~9500 A, the temperature of the cooling water is in a range of 35~40° C., and the flow of the cooling water is in a range of 130~150 $m^3$/h.

It is possible to, by controlling parameters such as the pressure, the pressure of the cooling water, voltage, electrical current, water temperature and water flow in the smelting chamber in the electroslag remelting step, control the molten steel-slag reaction process and the high-temperature vaporization effect in the electroslag remelting step, effectively control temperature retention and feeding, ensure compactness of the steel ingot, and thereby ensure the strength, toughness and drawing performance of the finally-fabricated wire rod for the ultra-thin ultra-high strength steel wire.

As a further improvement of an embodiment of the present invention, in the vacuum consumable remelting step, the consumable electrode rod is subjected to vacuum consumable crystallization and then remelting under a degree of vacuum in a range of 0.01~1 Pa. It is possible to, by optimizing the degree of vacuum in the vacuum consumable remelting step, ensure that the molten steel is not contaminated upon remelting, and meanwhile ensure the reaction conditions for the occurrence of dissociation or carbon reduction of the non-metallic inclusions, thereby achieving further purification, and ensuring the purity of the finally-fabricated wire rod for the ultra-thin ultra-high strength steel wire.

As a further improvement of an embodiment of the present invention, in the vacuum consumable remelting step, the steel ingot is taken as the consumable electrode rod, remelting is performed after energizing and starting the arc, the voltage for energizing and starting arc is in a range of 20~26V, and the length of the arc is in a range of 15~20 mm. It is possible to, by controlling the voltage for energizing and starting the arc and the length of the arc, ensure the remelting temperature reaches reaction conditions for the dissociation or carbon reduction of the non-metallic inclusions, further purify, and then ensure the purity of the finally-fabricated wire rod for the ultra-thin ultra-high strength steel wire.

As a further improvement of an embodiment of the present invention, in the vacuum consumable remelting step, the melting speed is in a range of 3.5~4.5 kg/min. The melting speed in this range can not only ensure that the steel ingot has an excellent crystallization quality and surface quality, the steel ingot does not have solidification drawbacks such as shrinkage cavity, porosity and segregation, and the surface of the steel ingot is smooth, but also minimize electricity consumption, save energy, and thereby ensure the strength, toughness and drawing performance of the finally-fabricated wire rod for the ultra-thin ultra-high strength steel wire.

DETAILED DESCRIPTION

Figure 1:
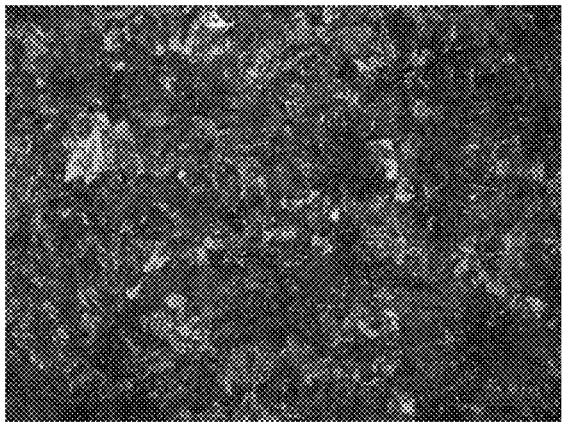
FIG. 1 is a metallographic structure diagram of a wire rod for an ultra-thin ultra-high strength steel wire according to Embodiment 1 of the present invention.

One embodiment of the present invention provides a wire rod for an ultra-thin ultra-high strength steel wire, and a method of producing the wire rod for the ultra-thin ultra-high strength steel wire.

The chemical components of the wire rod for an ultra-thin ultra-high strength steel wire of the present invention comprise in percentage by mass: C 0.90~0.96%, Si 0.12~0.30%, Mn 0.30~0.65%, Cr 0.10~0.30%, Al≤0.004%, Ti≤0.001%, Cu≤0.01%, Ni≤0.01%, S≤0.01%, P≤0.01%, O≤0.0006%, N≤0.0006%, and the balance is Fe and unavoidable impurity elements.

Further, the chemical components of the wire rod comprise in percentage by mass: C 0.90~0.94%, Si 0.12~0.30%, Mn 0.30~0.65%, Cr 0.10~0.30%, Al≤0.004%, Ti≤0.001%, Cu≤0.01%, Ni≤0.01%, S≤0.01%, P≤0.01%, O≤0.0006%, N≤0.0006%, and the balance is Fe and unavoidable impurity elements.

Furthermore, a size of the inclusion in the wire rod for the ultra-thin ultra-high strength steel wire is less than or equal to 4 μm, and an average density of a brittle inclusion in the wire rod for the ultra-thin ultra-high strength steel wire is less than or equal to $2/mm^2$, and a diameter of the wire rod for the ultra-thin ultra-high strength steel wire is 5.5 mm. Besides, it can be proved by numerous experimental studies that the wire rod for the ultra-thin ultra-high strength steel wire has a sorbite rate larger than or equal to 95%, an area reduction rate larger than or equal to 40%, and a tensile strength larger than or equal to 1300 MPa.

Furthermore, the wire rod for the ultra-thin ultra-high strength steel wire may be used as a base material for producing the ultra-thin ultra-high strength steel wire having a diameter in a range of 50~60 μm and a tensile strength larger than or equal to 4500 MPa, and during the process of further drawing the wire rod for the ultra-thin ultra-high strength steel wire into the ultra-thin ultra-high strength steel wire with the diameter of 50~60 μm, the mileage of the resultant continuous wire without break is longer than or equal to 300 km.

From another perspective, one embodiment of the present invention further provides an ultra-thin ultra-high strength steel wire which is fabricated from the wire rod for the ultra-thin ultra-high strength steel wire as the base material. For example, the ultra-thin ultra-high strength steel wire may be fabricated by performing a step of further drawing the wire rod for the ultra-thin ultra-high strength steel wire, the ultra-thin ultra-high strength steel wire has a diameter in a range of 50~60 μm and a tensile strength larger than or equal to 4500 MPa, and the mileage of the resultant continuous wire without break during the fabrication by drawing is longer than or equal to 300 km.

One embodiment of the present invention further provides a method of producing a wire rod for fabricating the ultra-thin ultra-high strength steel wire. As stated above, the production method according to the present invention is obtained according to a lot of experimental research. Steps of the production method will be further described below in conjunction with specific embodiments.

A First Implementation

A method of producing a wire rod for fabricating the ultra-thin ultra-high strength steel wire comprises the following steps:

(1) Smelting Step

Melting a charge into molten steel in a vacuum induction smelting furnace, refining the molten steel and regulating chemical components and inclusions in molten steel, and pouring the molten steel and casting to obtain a steel ingot.

Furthermore, after heating to melt the charge until all the charge is melted, filling argon into the smelting chamber until the pressure of the smelting chamber reaches $(0.8\sim1)\times10^4$ Pa, stirring for 2-4 min, regulating the temperature to 1540±5° C. and refining. The refining is completed in two times: during the primary refining, after refining 10 min each time, stirring for 2-4 min, and the primary refining lasts 25-40 min; sampling to analyze chemical components and inclusions in the molten steel, then replenishing argon into the smelting chamber until the pressure of the smelting chamber reaches $(2.5\sim3)\times10^4$ Pa, adding electrolytic manganese, stirring for 2-4 min, then proceeding to the secondary refining which lasts 15-25 min; sampling and analyzing, removing the inclusions, stirring for 2-4 min, then regulating the temperature to 1600±5° C., and pouring the molten steel and casting to obtain the steel ingot. Adjustment of the chemical components may be performed by adding chemical elements according to the components needed by the final molten steel.

(2) Remelting Step

The smelted steel ingot is crystallized and remelted to obtain a remelted ingot.

Furthermore, the remelting step comprises electroslag remelting step: forging the smelted steel ingot as a base material of a consumable electrode into a consumable electrode rod suitable for an electroslag remelting size of an electroslag furnace, removing a oxide skin from the surface of the consumable electrode rod, laying an arc initiating agent on a water jacket on the bottom of the electroslag furnace so that the consumable electrode rod, the arc initiating agent and the water jacket are in tight contact, baking the slag at a temperature in a range of 600~800° C. and then starting arc to form the slag, filling argon into the smelting chamber to pressurize the smelting chamber, then starting electroslag smelting, feeding and then lifting the consumable electrode rod and ending the smelting, releasing the pressure, reducing the temperature and then getting out the remelted ingot.

Preferably, the electroslag remelting step comprises performing the following in order:

A slag-forming stage;

A pressure-controlling stage: controlling the pressure of the smelting furnace to a range of 2~5 MPa, and making the pressure of cooling water in the crystallizer in a range of 2~5 MPa;

An electroslag smelting stage: the voltage is in a range of 35~38V, the electrical current is in a range of 8500~9500 A, the temperature of the cooling water is in a range of 35~40° C., and the flow of the cooling water is in a range of 130~150 $m^3/h$.

Preferably, the chemical components of the slag comprise in percentage by mass: CaO 6~14%, $Al_2O_3$ 8~15%, $SiO_2$ 20~28%, MgO<5%, and the balance is $CaF_2$.

Further preferably, the chemical components of the slag comprise in percentage by mass: CaO 10%, $Al_2O_3$10%, $SiO_2$ 25%, and the balance is $CaF_2$.

Preferably, the melting speed in the remelting step is in a range of 6.5~7.5 kg/min.

(3) A Forging Step

A homogenization thermal process is performed for the remelted ingot, and then forging is performed to obtain a billet.

Preferably, the temperature at which the forging is started is in a range of 1140-1160° C., and the temperature at which the forging is finished is in a range of 800-900° C.

(4) A Steel Rolling Step

The forged billet is rolled at a temperature in a range of 900~1100° C. to fabricate the wire rod for the ultra-thin ultra-high strength steel wire. The chemical components of the wire rod for the ultra-thin ultra-high strength steel wire comprises in percentage by mass: C 0.90~0.96%, Si 0.12~0.30%, Mn 0.30~0.65%, Cr 0.10~0.30%, Al≤0.004%, Ti≤0.001%, Cu≤0.01%, Ni≤0.01%, S≤0.01%, P≤0.01%, O≤0.0006%, N≤0.0006%, and the balance is Fe and unavoidable impurity elements.

Furthermore, the wire rod for the ultra-thin ultra-high strength steel wire is fabricated as having a diameter of 5.5 mm. The steel rolling step may comprise techniques such as billet heating, hot rolling and Stelmor cooling control.

Detailed description will be provided below through embodiments.

Embodiment 1

(1) Smelting

Melting a charge into molten steel in a vacuum induction smelting furnace, heating the charge until all the charge is melted, then filling argon into the smelting chamber until the pressure of the smelting chamber reaches $0.8\times10^4$ Pa, stirring for 4 min, and regulating the temperature to 1540° C. and refining; during the primary refining, after refining 10 min each time, stirring for 4 min, and the primary refining lasts 40 min; sampling to analyze chemical components and inclusions in the molten steel, then replenishing argon into the smelting chamber until the pressure of the smelting chamber reaches $2.5\times10^4$ Pa, adding electrolytic manganese, stirring for 4 min, then proceeding to the secondary refining which lasts 25 min; sampling and analyzing, removing the inclusions, stirring for 4 min, then regulating the temperature to 1600° C., and pouring the molten steel and casting to obtain the steel ingot.

(2) Electroslag Remelting

Forging the smelted steel ingot as a base material of a consumable electrode into a consumable electrode rod suitable for an electroslag remelting size of an electroslag furnace, removing a oxide skin from the surface of the consumable electrode rod, laying an arc initiating agent on a water jacket on the bottom of the electroslag furnace so that the consumable electrode rod, the arc initiating agent and the water jacket are in tight contact, baking the slag at a temperature of 600° C. and then starting the arc to form the slag, filling argon into the smelting chamber until the pressure of the smelting chamber reaches 2 MPa after completion of the slag formation, simultaneously adjusting the pressure of the cooling water in the electroslag crystallizer to 2 MPa, and then starting electroslag smelting; upon the electroslag smelting, the voltage is 38V, the electrical current is 9500 A, the temperature of the cooling water is 35° C., and the flow of the cooling water is 150 $m^3$/h; feeding and then lifting the consumable electrode rod and ending the smelting; releasing the pressure, reducing the temperature and then getting out the remelted ingot.

The chemical components of the slag comprise in percentage by mass: CaO 6%, $Al_2O_3$15%, $SiO_2$ 20%, MgO 5%, and the balance is $CaF_2$. The melting speed of the electroslag smelting is 6.5 kg/min.

(3) Forging

A homogenization thermal process is performed for the remelted ingot, and then forging is performed to obtain a billet. The temperature at which the forging is started is 1140° C., and the temperature at which the forging is finished is 800° C.

(4) Steel Rolling

The forged billet is rolled at a temperature of 900° C. The rolling techniques including billet heating, hot rolling and Stelmor cooling control are employed to fabricate the wire rod for the ultra-thin ultra-high strength steel wire with a diameter of 5.5 mm. The chemical components of the wire rod for the ultra-thin ultra-high strength steel wire and information regarding the mass percentages of the chemical components are shown in Table 1.

The performances of the fabricated wire rod for the ultra-thin ultra-high strength steel wire are detected. The measured tensile strength, area reduction, sorbitic content and information of inclusions are shown in Table 2. The structure of the wire rod is mainly sorbite, and a small amount of pearlite. The metallographic structure is as shown in FIG. 1. The wire rod substantially does not have segregation of the structure. The wire rod is then subjected to deep processing, and drawn into the ultra-thin ultra-high strength steel wire. The wire rod is measured and the performances thereof are detected. The information of the ultra-thin ultra-high strength steel wire such as the diameter, tensile strength and drawing mileage i.e., the mileage of the wire without break when the wire rod is drawn into the steel wire are as shown in Table 3.

A Second Implementation

The second implementation differs from the first implementation in the remelting step, specifically as follows:

The remelting step comprises a vacuum consumable remelting step: taking the smelted steel ingot as a consumable electrode rod, placing the smelted steel ingot in the vacuum consumable remelting furnace, energizing and starting arc, then performing vacuum consumable crystallization and remelting to obtain the remelted ingot.

Preferably, the consumable electrode rod is subjected to vacuum consumable crystallization and then remelting under a degree of vacuum in a range of 0.01~1 Pa.

Preferably, the voltage for energizing and starting arc is in a range of 20~26V, and the length of the electric arc is in a range of 15~20 mm.

Preferably, the melting speed in the vacuum consumable remelting is in a range of 3.5~4.5 kg/min.

Except for the above difference, other steps of the second implementation and first implementation are all the same, and will not be detailed any more here.

Detailed description will be provided below through embodiments.

Embodiment 2

(1) Smelting

Melting a charge into molten steel in a vacuum induction smelting furnace, heating the charge until all the charge is melted, then filling argon into the smelting chamber until the pressure of the smelting chamber reaches $1.0\times10^4$ Pa, stirring for 2 min, and regulating the temperature to 1545° C. for refining; during the primary refining, after refining 10 min each time, stirring for 3 min, and the primary refining lasts 25 min; sampling to analyze chemical components and inclusions in the molten steel, then replenishing argon into the smelting chamber until the pressure of the smelting chamber reaches $3\times10^4$ Pa, adding electrolytic manganese, stirring for 3 min, then proceeding to the secondary refining which lasts 20 min; sampling and analyzing, removing the inclusions, stirring for 3 min, then regulating the temperature to 1605° C., and pouring the molten steel and casting to obtain the steel ingot.

(2) Vacuum Consumable Remelting

The smelted steel ingot is taken as the consumable electrode rod, the consumable electrode rod is placed in the vacuum consumable remelting furnace, the degree of vacuum in the vacuum consumable remelting furnace is controlled to 0.01 Pa, the voltage for energizing and starting arc is 20V, and the length of the electric arc is 20 mm. After energizing and starting the arc, vacuum consumable crystallization and remelting are performed at a melting speed of 4.5 kg/min to fabricate the remelted ingot.

(3) Forging

A homogenization thermal process is performed for the remelted ingot, and then forging is performed to obtain a billet. The temperature at which the forging is started is 1160° C., and the temperature at which the forging is finished is 900° C.

(4) Steel Rolling

The forged billet is rolled at a temperature of 1000° C. The rolling techniques including billet heating, hot rolling and Stelmor cooling control are employed to fabricate the wire rod for the ultra-thin ultra-high strength steel wire with a diameter of 5.5 mm. The chemical components of the wire rod for the ultra-thin ultra-high strength steel wire and information regarding the mass percentages of the chemical components are shown in Table 1.

Figure 2:
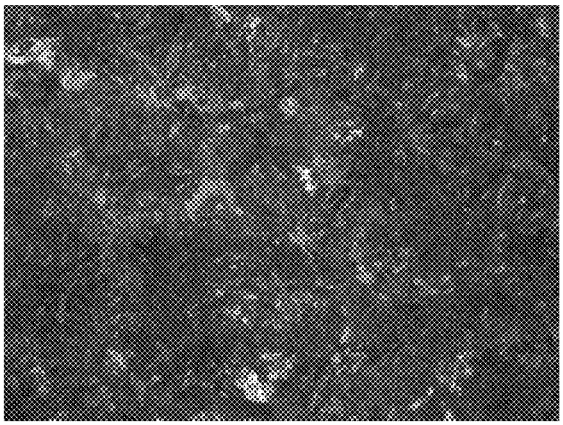
FIG. 2 is a metallographic structure diagram of a wire rod for an ultra-thin ultra-high strength steel wire according to Embodiment 2 of the present invention.

The performances of the fabricated wire rod for the ultra-thin ultra-high strength steel wire are detected. The measured tensile strength, area reduction, sorbitic content and information of inclusions are shown in Table 2. The structure of the wire rod is mainly sorbite, and a small amount of pearlite. The metallographic structure is as shown in FIG. 2. The wire rod substantially does not have segregation of the structure. The wire rod is then subjected to deep processing, and drawn into the ultra-thin ultra-high strength steel wire. The wire rod is measured and the performances thereof are detected. The information of the ultra-thin ultra-high strength steel wire such as the diameter, tensile strength and drawing mileage (i.e., the mileage of the wire without break when the wire rod is drawn into the steel wire) are as shown in Table 3.

A Third Implementation

The third implementation differs from the first implementation in the remelting step, specifically as follows:

The remelting step comprises:

(1) An electroslag remelting step: forging the smelted steel ingot as a base material of a consumable electrode into a consumable electrode rod suitable for an electroslag remelting size of an electroslag furnace, removing a oxide skin from the surface of the consumable electrode rod, laying an arc initiating agent on a water jacket on the bottom of the electroslag furnace so that the consumable electrode rod, the arc initiating agent and the water jacket are in tight contact, baking the slag at a temperature in a range of 600~800° C. and then starting arc to form the slag, filling argon into the smelting chamber to pressurize the smelting chamber, then starting electroslag smelting, feeding and then lifting the consumable electrode rod and ending the smelting, releasing the pressure, reducing the temperature and then getting out the remelted ingot.

Preferably, the electroslag remelting step comprises performing the following in order:

A slag-forming stage;

A pressure-controlling stage: controlling the pressure of the smelting furnace to a range of 2~5 MPa, and making the pressure of cooling water in the crystallizer in a range of 2~5 MPa;

An electroslag smelting stage: the voltage is in a range of 35~38V, the electrical current is in a range of 8500~9500 A, the temperature of the cooling water is in a range of 35~40° C., and the flow of the cooling water is in a range of 130~150 $m^3$/h.

Preferably, the chemical components of the slag comprise in percentage by mass: CaO 6~14%, $Al_2O_3$ 8~15%, $SiO_2$ 20~28%, MgO<5%, and the balance is $CaF_2$.

Further preferably, the chemical components of the slag comprise in percentage by mass: CaO 10%, $Al_2O_3$10%, $SiO_2$ 25%, and the balance is $CaF_2$.

Preferably, the melting speed in the electroslag remelting is in a range of 6.5~7.5 kg/min.

(2) A Vacuum Consumable Remelting Step

The smelted ingot after the electroslag remelting is taken as the consumable electrode rod, and the consumable electrode rod is placed in the vacuum consumable remelting furnace. After energizing and starting the arc, vacuum consumable crystallization and remelting are performed to obtain the remelted ingot.

Preferably, the consumable electrode rod is subjected to vacuum consumable crystallization and then remelting under a degree of vacuum in a range of 0.01~1 Pa.

Preferably, the voltage for energizing and starting arc is in a range of 20~26V, and the length of the electric arc is in a range of 15~20 mm.

Preferably, the melting speed in the vacuum consumable remelting is in a range of 3.5~4.5 kg/min.

Except for the above difference, other steps of the third implementation and first implementation are all the same, and will not be detailed any more here.

Detailed description will be provided below through embodiments.

Embodiment 3

(1) Smelting

Melting a charge into molten steel in a vacuum induction smelting furnace, heating the charge until all the charge is melted, then filling argon into the smelting chamber until the pressure of the smelting chamber reaches $0.9\times10^4$ Pa, stirring for 3 min, and regulating the temperature to 1535° C. for refining; during the primary refining, after refining 10 min each time, stirring for 2 min, and the primary refining lasts 32 min; sampling to analyze chemical components and inclusions in the molten steel, then replenishing argon into the smelting chamber until the pressure of the smelting chamber reaches $2.8\times10^4$ Pa, adding electrolytic manganese, stirring for 2 min, then proceeding to the secondary refining which lasts 15 min; sampling and analyzing, removing the inclusions, stirring for 2 min, then regulating the temperature to 1595° C., and pouring the molten steel and casting to obtain the steel ingot.

(2) Electroslag Remelting

Forging the smelted steel ingot as a base material of a consumable electrode into a consumable electrode rod suitable for an electroslag remelting size of an electroslag furnace, removing a oxide skin from the surface of the consumable electrode rod, laying an arc initiating agent on a water jacket on the bottom of the electroslag furnace so that the consumable electrode rod, the arc initiating agent and the water jacket are in tight contact, baking the slag at a temperature of 800° C. and then starting the arc to form the slag, filling argon into the smelting chamber until the pressure of the smelting chamber reaches 5 MPa after completion of the slag formation, simultaneously adjusting the pressure of the cooling water in the electroslag crystallizer to 5 MPa, and then starting electroslag smelting; upon the electroslag smelting, the voltage is 35V, the electrical current is 8500 A, the temperature of the cooling water is 40° C., and the flow of the cooling water is 130 $m^3$/h; feeding and then lifting the consumable electrode rod and ending the smelting; releasing the pressure, reducing the temperature and then getting out the remelted ingot.

The chemical components of the slag comprise in percentage by mass: CaO 14%, $Al_2O_3$ 8%, $SiO_2$ 28%, MgO 3%, and the balance is $CaF_2$. The melting speed of the electroslag smelting is 7.5 kg/min.

(3) Vacuum Consumable Remelting

The remelted ingot after the electroslag remelting is taken as the consumable electrode rod, the consumable electrode rod is placed in the vacuum consumable remelting furnace, the degree of vacuum in the vacuum consumable remelting furnace is controlled to 1 Pa, the voltage for energizing and starting arc is 26V, and the length of the electric arc is 15 mm. After energizing and starting the arc, vacuum consumable crystallization and remelting are performed at a melting speed of 3.5 kg/min to fabricate the steel ingot.

(4) Forging

A homogenization thermal process is performed for the steel ingot after the vacuum consumable remelting, and then forging is performed to obtain a billet. The temperature at which the forging is started is 1150° C., and the temperature at which the forging is finished is 850° C.

(5) Steel Rolling

The forged billet is rolled at a temperature of 1100° C. The rolling techniques including billet heating, hot rolling and Stelmor cooling control are employed to fabricate the wire rod for the ultra-thin ultra-high strength steel wire with a diameter of 5.5 mm. The chemical components of the wire rod for the ultra-thin ultra-high strength steel wire and information regarding the mass percentages of the chemical components are shown in Table 1.

Figure 3:
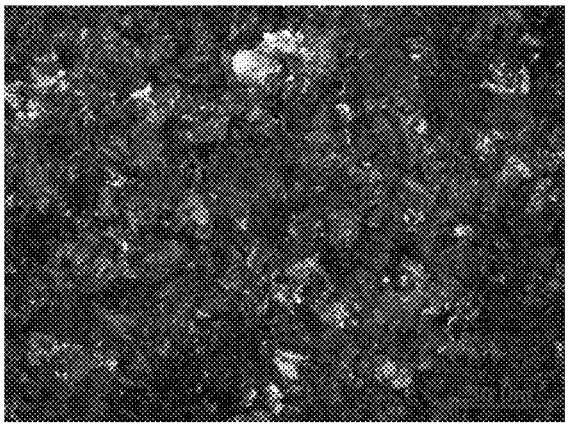
FIG. 3 is a metallographic structure diagram of a wire rod for an ultra-thin ultra-high strength steel wire according to Embodiment 3 of the present invention.

The performances of the fabricated wire rod for the ultra-thin ultra-high strength steel wire are detected. The measured tensile strength, area reduction, sorbitic content and information of inclusions are shown in Table 2. The structure of the wire rod is mainly sorbite, and a small amount of pearlite. The metallographic structure is as shown in FIG. 3. The wire rod substantially does not have segregation of the structure. The wire rod is then subjected to deep processing, and drawn into the ultra-thin ultra-high strength steel wire. The wire rod is measured and the performances thereof are detected. The information of the ultra-thin ultra-high strength steel wire such as the diameter, tensile strength and drawing mileage (i.e., the mileage of the wire without break when the wire rod is drawn into the steel wire) are as shown in Table 3.

TABLE 1

| Chemical components, wt % | Embodiment 1 | Embodiment 2 | Embodiment 3 |
|---|---|---|---|
| C | 0.90 | 0.92 | 0.94 |
| Si | 0.30 | 0.20 | 0.12 |
| Mn | 0.65 | 0.45 | 0.30 |
| Cr | 0.10 | 0.20 | 0.30 |
| Al | 0.004 | 0.003 | 0.002 |
| Ti | 0.0007 | 0.0005 | 0.001 |
| Cu | 0.01 | 0.005 | 0.006 |
| Ni | 0.01 | 0.006 | 0.008 |
| S | 0.01 | 0.002 | 0.0018 |
| P | 0.01 | 0.005 | 0.0044 |
| O | 0.0006 | 0.00044 | 0.0004 |
| N | 0.0006 | 0.0006 | 0.00055 |
| Fe and unavoidable impurity elements | Balance | Balance | Balance |

TABLE 2

| Embodiments | | Embodiment 1 | Embodiment 2 | Embodiment 3 |
|---|---|---|---|---|
| Tensile strength, MPa | Head | 1320.50 | 1336.27 | 1350.35 |
| | Tail | 1305.50 | 1324.40 | 1332.28 |
| Area reduction, % | Head | 42.75 | 41.88 | 41.22 |
| | Tail | 41.24 | 40.26 | 40.10 |
| Sorbitic content, % | | 95 | 96 | 97 |
| Average density of brittle inclusions, /mm$^2$ | | 2 | 1 | 1 |
| Maximum size of the inclusion, μm | | 4 | 3 | 3 |

TABLE 3

| Embodiments | Embodiment 1 | Embodiment 2 | Embodiment 3 |
|---|---|---|---|
| Diameter, μm | 60 | 55 | 50 |
| Tensile strength, MPa | 4512 | 4608 | 4720 |
| Drawing mileage, km | ≥300 | ≥300 | ≥300 |

To conclude, as compared with the prior art, the present invention has the following advantageous effects:

(1) The size, strength and purity of the wire rod for the ultra-thin ultra-high strength steel wire are controlled by controlling the chemical components and mass percentages, wherein the structure and strength of the wire rod for the ultra-thin ultra-high strength steel wire are controlled by controlling content of elements such as C, Si, Mn and Cr and carbon-free segregation in the wire rod; the amount of inclusions is controlled by controlling the content of elements such as Al, Ti, O and N that generate brittle inclusions; in the finally-fabricated wire rod for ultra-thin ultra-high strength steel wire, the content of full oxygen is less than or equal to 0.0006%, the content of N is less than or equal to 0.0006%, the size of the inclusions is less than or equal to 4 μm, and the average density of the brittle inclusions is less than or equal to 2 inclusions/mm$^2$. The wire rod for the ultra-thin ultra-high strength steel wire with a diameter of 5.5 mm has a sorbite rate larger than or equal to 95%, an area reduction rate larger than or equal to 40%, and a tensile strength larger than or equal to 1300 MPa. The purity of the wire rod is substantially improved, and the wire rod has excellent strength, toughness and drawing performance. The wire rod facilitates fabricating a drawn steel wire with a higher purity, a smaller diameter and a longer mileage of the continuous wire without break.

(2) On one hand, through operations such as the smelting and remelting, precise control of chemical components of the wire rod for the ultra-thin ultra-high strength steel wire is achieved, and the strength and the drawing performance thereof are improved; on the other hand, it is possible to, by remelting, control the components and crystallization directions of the inclusions, remove the inclusions to a larger degree, reduce the sizes of the inclusions, improve the purity of the wire rod, and further control the wire rod free from central segregation. The structure of the wire rod is more uniform and compact, the steel ingots do not have solidification drawbacks such as shrinkage cavity, porosity and segregation, and the plasticity and toughness of the steel ingots at a low temperature, a room temperature and a high temperature are enhanced, so that the chemical components and inclusions of the finally-fabricated wire rod for the ultra-thin ultra-high strength steel wire are effectively and precisely controlled, and the wire rod is ensured to have a high strength, an excellent drawing performance and a high purity, and it is further ensured that the ultra-thin ultra-high strength steel wire fabricated by drawing from the wire rod has an ultra-small diameter, an ultra-high tensile strength, a super-long mileage of continuous wire without break and an ultra-high purity.

What is claimed is:

1. A method of producing a wire rod for the steel wire, wherein the steel wire has a diameter in a range of 50~60 μm, a tensile strength larger than or equal to 4500 MPa;

the method comprises the following steps:

smelting: melting a charge into molten steel in a vacuum induction smelting furnace, refining the molten steel and regulating chemical components and inclusions in molten steel, and pouring the molten steel and casting to obtain a steel ingot;

electroslag remelting: forging the smelted steel ingot as a base material of a consumable electrode into a consumable electrode rod suitable for an electroslag remelting size of an electroslag furnace, removing a oxide skin from the surface of the consumable electrode rod, laying an arc initiating agent on a water jacket on the bottom of the electroslag furnace so that the consumable electrode rod, the arc initiating agent and the water jacket are in tight contact, baking the slag at a temperature in a range of 600~800° C. and then starting arc to form the slag, filling argon into the smelting chamber to pressurize the smelting chamber, then starting electroslag smelting, feeding and then lifting the consumable electrode rod and ending the smelting, releasing the pressure, reducing the temperature and then getting out the remelted ingot; wherein the electroslag remelting step comprises the following in order:

a slag-forming stage;

a pressure-controlling stage: controlling the pressure of the smelting furnace to a range of 2~5 MPa, and making the pressure of cooling water in a crystallizer in a range of 2~5 MPa;

an electroslag smelting stage: the voltage is in a range of 35~38V, the electrical current is in a range of 8500~9500 A, the temperature of the cooling water is in a range of 35~40° C., and the flow of the cooling water is in a range of 130~150 m3/h;

vacuum consumable remelting: taking the smelted steel ingot as a consumable electrode rod, placing the smelted steel ingot in the vacuum consumable remelting furnace, energizing and starting arc, then performing vacuum consumable crystallization and remelting under a degree of vacuum in a range of 0.01~1 Pa to obtain a remelted ingot;

forging: performing a homogenization thermal process for the remelted ingot, and then performing forging to obtain a billet;

steel rolling: rolling the billet at a temperature in a range of 900~1100° C. to fabricate the wire rod for the steel wire, where the chemical components of the wire rod for the steel wire comprises in percentage by mass: C 0.90~0.96%, Si 0.12~0.30%, Mn 0.30~0.65%, Cr 0.10~0.30%, Al≤0.004%, Ti≤0.001%, Cu≤0.01%, Ni≤0.01%, S≤0.01%, P≤0.01%, O≤0.0006%, N≤0.0006%, and the balance is Fe and unavoidable impurity elements, the steel rolling step comprises billet heating, hot rolling and Stelmor cooling control.

2. The method of producing a wire rod for the steel wire according to claim 1, wherein in the electroslag remelting step, the chemical components of the slag comprise in percentage by mass: CaO 6~14%, $Al_2O_3$ 8~15%, $SiO_2$ 20~28%, MgO<5%, and the balance is $CaF_2$; the melting speed is in a range of 6.5~7.5 kg/min.

3. The method of producing a wire rod for the steel wire according to claim 2, wherein in the electroslag remelting step, the chemical components of the slag comprise in percentage by mass: CaO 10%, $Al_2O_3$ 10%, $SiO_2$ 25%, and the balance is $CaF_2$.

4. The method of producing a wire rod for the steel wire according to claim 1, wherein in the vacuum consumable remelting step, the steel ingot is taken as a consumable electrode rod, remelting is performed after energizing and starting the arc, the voltage for energizing and starting arc is in a range of 20~26V, and the length of the arc is in a range of 15~20 mm, the melting speed is in a range of 3.5~4.5 kg/min.

5. The method of producing a wire rod for the steel wire according to claim 1, wherein in the smelting step, after heating to melt the charge until all the charge is melted, filling argon into the smelting chamber until the pressure of the smelting chamber reaches $(0.8\sim1)\times10^4$ Pa, stirring for 2-4 min, regulating the temperature to 1540±5° C. and refining, The refining is completed in two times: during the primary refining, after refining 10 min each time, stirring for 2-4 min, and the primary refining lasts 25-40 min; sampling to analyze chemical components and inclusions in the molten steel, then replenishing argon into the smelting chamber until the pressure of the smelting chamber reaches $(2.5\sim3)\times10^4$ Pa, adding electrolytic manganese, stirring for 2-4 min, then proceeding to the secondary refining which lasts 15-25 min; sampling and analyzing, removing the inclusions, stirring for 2-4 min, then regulating the temperature to 1600±5° C., and pouring the molten steel and casting to obtain the steel ingot, Adjustment of the chemical components may be performed by adding chemical elements according to the components needed by the final molten steel;

in the forging step, the temperature at which the forging is started is in a range of 1140-1160° C., and the temperature at which the forging is finished is in a range of 800-900° C.

6. The method of producing a wire rod for the steel wire according to claim 1, wherein the chemical components of the wire rod comprise in percentage by mass: C 0.90~0.94%, Si 0.12~0.30%, Mn 0.30~0.65%, Cr 0.10~0.30%, Al≤0.004%, Ti≤0.001%, Cu≤0.01%, Ni≤0.01%, S≤0.01%, P≤0.01%, O≤0.0006%, N≤0.0006%, and the balance is Fe and unavoidable impurity elements.

7. The method of producing a wire rod for the steel wire according to claim 1, wherein a diameter of the wire rod is 5.5 mm, a size of the inclusion in the wire rod is less than or equal to 4 μm, and an average density of a brittle inclusion in the wire rod is less than or equal to $2/mm^2$; the wire rod has a sorbite rate larger than or equal to 95%, an area reduction rate larger than or equal to 40%, and a tensile strength larger than or equal to 1300 MPa, and a mileage of continuous wire without break longer than or equal to 300 km during fabrication by drawing.

* * * * *